US005769140A

United States Patent [19]

Tuzmen

[11] Patent Number: 5,769,140

[45] Date of Patent: Jun. 23, 1998

[54] HOLELESS WINDOW BLIND

[76] Inventor: Zeki Tuzmen, 11 Wakefield, Irvine, Calif. 92620

[21] Appl. No.: 715,127

[22] Filed: Sep. 17, 1996

[51] Int. Cl.[6] ..... E06B 9/30

[52] U.S. Cl. ..... 160/168.1 R; 160/173 R; 160/178.3 R; 160/177 R; 160/900

[58] Field of Search ..... 160/168.1 R, 173 R, 160/178.3 R, 900, 174 R, 176.7 R, 177 R

[56] References Cited

U.S. PATENT DOCUMENTS

| | | | |
|---|---|---|---|
| 2,200,349 | 5/1940 | Walker . | |
| 2,251,363 | 8/1941 | McGrew | 160/178.3 R X |
| 2,532,617 | 12/1950 | Hauser et al. . | |
| 2,662,593 | 12/1953 | Walker . | |
| 2,728,108 | 12/1955 | Schlegel, Jr. | 160/178.3 R X |
| 2,757,727 | 8/1956 | Findell . | |
| 2,796,927 | 6/1957 | Evans . | |
| 3,086,586 | 4/1963 | Wolfe . | |
| 3,916,973 | 11/1975 | Schuppler et al. | 160/178.3 R |
| 3,971,427 | 7/1976 | Coldewey et al. | 160/168.1 R |
| 4,236,567 | 12/1980 | Frentzel | 160/178.3 R |
| 4,377,194 | 3/1983 | Tsuhanko | 160/168.1 R |
| 4,530,390 | 7/1985 | Schluep et al. | 160/178.3 R |
| 4,763,713 | 8/1988 | Kraus . | |
| 5,386,867 | 2/1995 | Chen | 160/168.1 R |
| 5,465,775 | 11/1995 | Biba et al. | 160/168.1 R |
| 5,597,027 | 1/1997 | Simon et al. | 160/178.3 R X |

FOREIGN PATENT DOCUMENTS

| | | | |
|---|---|---|---|
| 12687 | 7/1903 | Austria | 160/178.3 |
| 3414354 | 10/1985 | Germany | 160/178.3 |

*Primary Examiner*—Kenneth J. Dorner
*Assistant Examiner*—Bruce A. Lev
*Attorney, Agent, or Firm*—Wallenstein & Wagner, Ltd.

[57] ABSTRACT

A window blind (10) is disclosed having a headrail (12) housing a tilt assembly (18) and a plurality of slats (14) having opposed longitudinal edges (36). The blind (10) has a sleeve (28) extending from the tilt assembly (18) to a bottommost slat (14) along the longitudinal edges (36) of each slat (14). Each slat (14) has a clip (38) that engages the longitudinal edges (36) of each slat (14). A loop (40) is positioned around the clip (38) and through a pair of openings (48) in the sleeve (28) to connect the sleeve (28) to the each slat (14). A lift cord (30) extends from the headrail (12) to the bottommost slat (14) along the longitudinal edge (36) of each slat (14) where it is connected to the bottommost slat (14). The lift cord (30) is within the sleeve (28).

15 Claims, 2 Drawing Sheets

HOLELESS WINDOW BLIND

TECHNICAL FIELD

The present invention relates generally to window blinds, and more particularly to a holeless window blind having an improved tilt/lift mechanism.

BACKGROUND OF THE INVENTION

Window blinds having a plurality of equally spaced, parallel, horizontal slats are well-known and are oftentimes referred to as venetian blinds. In these conventional blinds, the individual slats are supported by a pair of ladder tapes having cross-members, sometimes referred to as ladder cords, extending therebetween. In addition, lift cords extend down from a headrail, or valance, through holes in the center of each slat, to a bottom rail. The lift cords are used to adjust the height of the window blind.

There are a number of disadvantages in these conventional window blinds. The use of ladder cords to support the slats unduly increases the stack height of the window blind when the blind is raised to its uppermost position. A small stack height is desirable to maximize the open area of a window when the blind is raised to its uppermost position. The use of ladder cords also hinders the complete tilting and, thus, complete closure of the slats. By routing the lift cords through holes in the slats, privacy is limited because, like the ladder cords, the lift cords hinder the complete tilting and thus, complete closure of the slats as well. In addition, even when the slats are closed, some light can still pass through the slats because of the holes. Finally, with the lift cords passing through each slat, the individual slats cannot be removed from the blind for cleaning, repair or replacement.

Some blinds have been designed having removable slats for cleaning and repair. For example, U.S. Pat. No. 3,086,586 discloses a blind with slats having contoured slots. Upon assembly, the lift cords are inserted into the slats via the contoured slots. To remove the slat from the blind, the lift cords are simply removed from the slat via the contoured slots. U.S. Pat. No. 2,662,593 discloses a blind that eliminates slots in the slats but adds notches on the sides of the slats in order to attach a rigid wire clip to the slats. The rigid wire clip is required to retain the slats to the ladder cords. U.S. Pat. No. 2,532,617 also discloses a blind that eliminates slots in the slats. This blind, however, employs ladder cords and compound clips to retain the slats to the ladder cords. Although these blinds allow for slat removal, the blinds still suffer from increased stack height, incomplete closure of the slats, and light passage through the holes, or slots in the slats. Furthermore, these blinds are complex and costly.

SUMMARY OF THE INVENTION

A blind assembly in accordance with the present invention eliminates the drawbacks and difficulties of the conventional blind assemblies described above.

According to a first aspect of the invention, a window blind is disclosed having a headrail housing a tilt assembly and a plurality of slats. The slats have opposed longitudinal edges. The blind further has a sleeve extending from the tilt assembly to a bottommost slat along at least one longitudinal edge of each slat. A means is provided for connecting the sleeve to each slat. The blind also has a lift cord within the sleeve, extending from the headrail to the bottommost slat where it is connected to the bottommost slat. The slats are solid members having no holes, and can be removed from the blind for cleaning, repair or replacement.

According to another aspect of the invention, a clip and a loop are provided for each slat to connect the sleeve to the slats. The clip engages a longitudinal edge of the slat and the loop cooperates with the clip and the sleeve.

According to another aspect of the invention, the headrail houses a clutch proximate a front portion of the headrail. The lift cords enter the front of the headrail and extend to the clutch along an axis substantially parallel to a longitudinal axis of the headrail.

Other advantages and aspects of the present invention will become apparent upon reading the following description of the drawings and detailed description of the invention.

DETAILED DESCRIPTION

Figure 1:
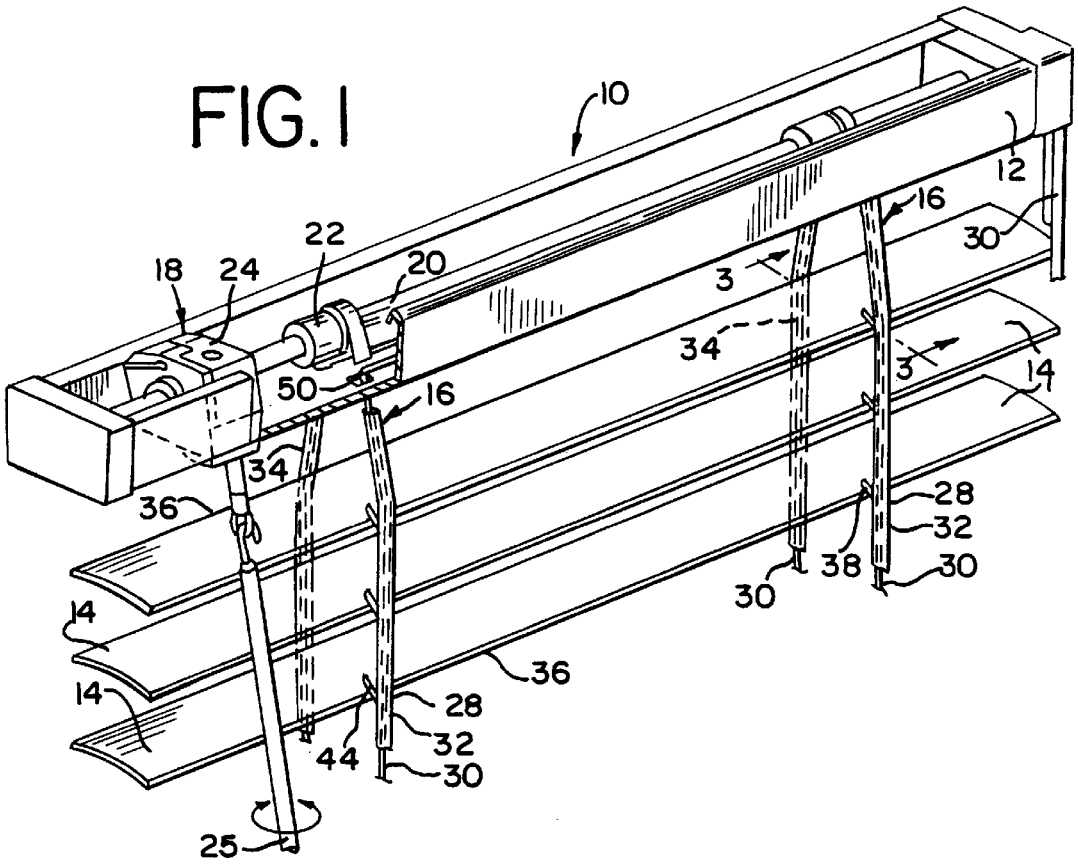
FIG. 1 is a partial perspective view of the window blind of the present invention.

While this invention is susceptible of embodiment in many different forms, there is shown in the drawings and will herein be described in detail a preferred embodiment of the invention with the understanding that the present disclosure is to be considered as an exemplification of the principles of the invention and is not intended to limit the broad aspect of the invention to the embodiments illustrated.

Referring to the drawings, FIG. 1 shows a window blind 10 of the present invention. The blind 10 generally includes a headrail 12, or valance, a plurality of slats 14, and a tilt/lift mechanism 16.

Figure 2:
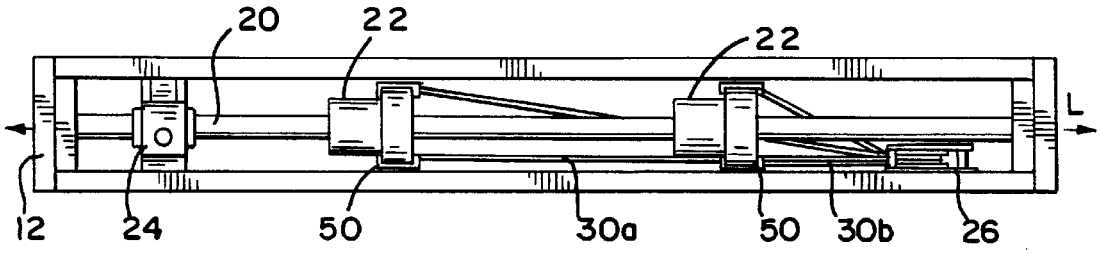
FIG. 2 is a top plan view of a headrail of the window blind of FIG. 1 showing a tilt assembly and a lift cord clutch.

The headrail 12 is secured above a window frame (not shown) in any conventional manner such as by screws or nails. It is understood that the present invention could also be used in doorways or other openings requiring blinds. As shown in FIGS. 1 and 2, the headrail 12 houses certain mechanical devices used to operate the blind 10. For instance, a tilt assembly 18 is housed with the headrail 12. The tilt assembly 18 includes a shaft 20 with rollers 22 and a gear mechanism 24. The shaft 20 is positioned longitudinally within the headrail 12 and cooperates with the gear mechanism 24 to tilt the blind 10. This will be described in greater detail below. A lift cord clutch 26 is also housed in the headrail 12 to cooperate with lift cords to vary the height of the blind 10.

FIG. 1 also shows the plurality of slats 14 included in the window blind 10. The number of slats 14 utilized will vary depending on the vertical size of the window or opening. Each slat 14 has a generally uniform size and rectangular shape. The slats 14 are solid and have no holes, apertures, slots, notches or other perforations. Thus, the slats 14 have uniform strength throughout their entire length and are not subject to undue creasing, bending or other deformation. The slats 14 can be constructed of a number of different materials such as wood, metal, plastic, aluminum or other rigid material. The lowermost slat of the blind is typically referred to as a bottom rail (not shown). The bottom rail can be a standard slat, but it is usually a thicker, heavier slat. A heavier slat is used as a bottom rail to maintain the straight vertical shape of the opened blind when wind passes through an open window thus blowing through the plurality of slats of the blind 10.

Figure 3:
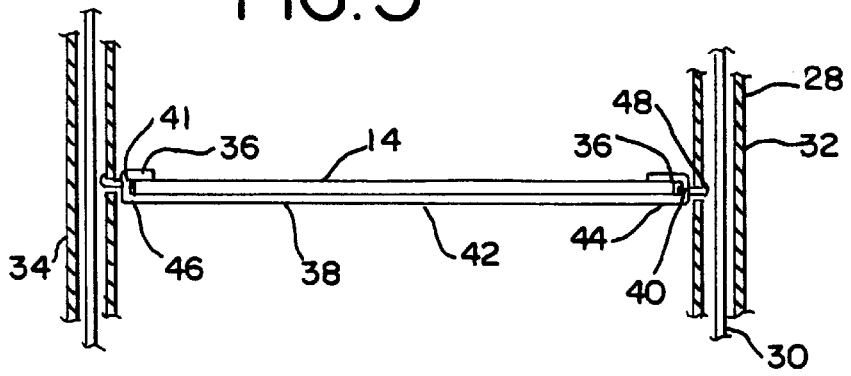
FIG. 3 is a partial cross-sectional view taken along Line 3—3 in FIG. 1 showing a tilt/lift mechanism of the present invention.
Figure 4:
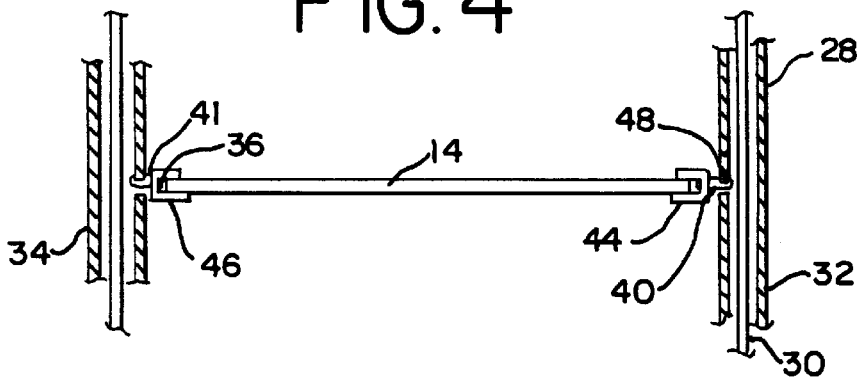
FIG. 4 is a partial cross-sectional view also taken along Line 3—3 in FIG. 1 showing an alternative embodiment of the tilt/lift mechanism; and, FIG. 5 is an enlarged partial cross-sectional view showing a connection between a sleeve and slat of the window blind of FIG. 1.

FIGS. 1, 3 and 4 show the tilt/lift mechanism 16 of the present invention. As shown in FIG. 1, a pair of tilt/lift mechanisms 16 are included, one on each end of the blind 10. Depending on the size of the window blind, more tilt/lift mechanisms 16 could also be utilized. Also, a single tilt/lift mechanism 16 could be utilized with smaller blinds. In the preferred embodiment, however, a tilt/lift mechanism 16 is included on each end of the blind 10. The structure of one of the tilt/lift mechanisms 16 will be described in detail with the understanding that the other mechanism has similar structure.

The tilt/lift mechanism 16 generally includes a sleeve 28 and lift cords 30. The sleeve 28 has a first sleeve member 32 and a second sleeve member 34. If sufficiently rigid structure is used to connect the sleeve 32 to the slats, a single sleeve member could be utilized. The sleeve 28, however, preferably includes a pair of sleeve members 32,34. The sleeve members 32,34 extend from the headrail 12 to the bottom rail. The sleeve members 32,34 confront one another and are positioned along opposing longitudinal edges 36 of each slat 14. The sleeve 28 is preferably made from flexible woven or non-woven material made tubular by adhesives or stitching. The sleeve 28 could also be made from tubular braided or tubular knit fabrics.

Figure 5:
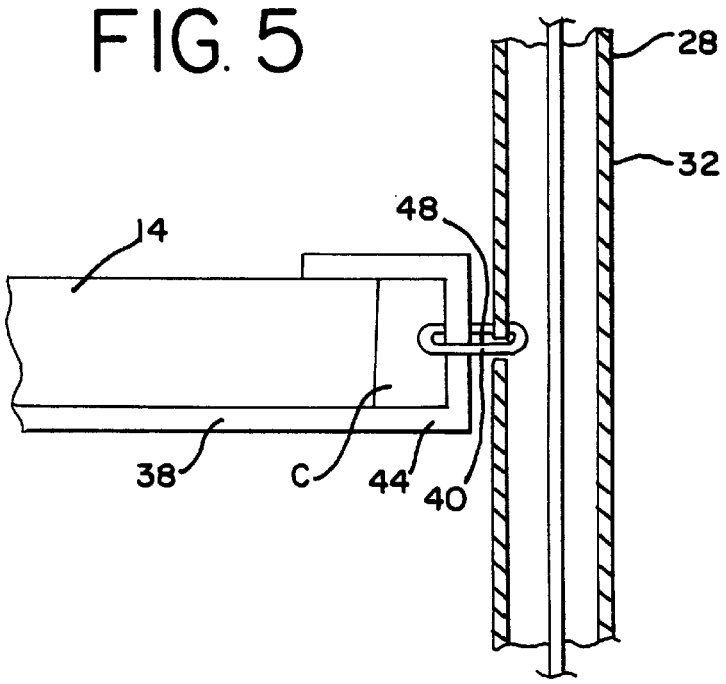

The sleeve members 32,34 are connected to each slat 14 of the blind 10 proximate the longitudinal edges 36 of the slats 14. This connection can be made in a variety of different ways. FIGS. 3 and 4 show a preferred embodiment of this connection, which includes a clip 38 and a loop 40. The clip 38 is preferably a thin, spring metal strip; it can also be constructed of plastic, rubber or other materials. The loop 40 is preferably made from high strength thread (e.g. nylon); it can also be constructed of plastic, rubber, metal or other suitable material for connection through the sleeve 28. The clip 38 engages the slat 14 and the loop 40 cooperates with the clip 38 and sleeve 28 to connect the sleeve 28 to the slat 14. Specifically, the clip 38 is attached to the slat 14 and includes a main portion 42 and a first engaging member 44 and a second engaging member 46. The main portion 42, being of a very thin cross-section (shown enlarged in FIGS. 3 and 4), is positioned along an underside of the slat 14. The first and second engaging members 44,46 frictionally engage, or grip, the opposing longitudinal edges 36 of the slat 14. Some clearance C (FIG. 5) may be maintained between the engaging members 44,46 and the longitudinal edges 36 of the slat 14. As shown in FIG. 3, a first loop 40 is then positioned around the first engaging member 44 and through a pair of openings 48 in the first sleeve member 32 (a single opening being shown in FIG. 3) to connect the sleeve 28 to the slat 14. FIG. 5 is an enlarged view showing, in greater detail, the clip 38 and the loop 40 connecting the sleeve 28 to the slat 14. If desired, the loop 40 can be sewn directly to the sleeve 28. Likewise, a second loop 41 is positioned around the second engaging member 46 and through a pair of openings 48 in the second sleeve member 34. As shown in FIG. 1, these connections are made for each slat 14 along the length of the sleeve 28.

FIG. 4 shows an alternative clip 38 that can be used in the present invention. Here, the clip 38 is simply comprised of the first engaging member 44 and second engaging member 46 without the use of the main portion 42. As in FIG. 3, the first loop 40 is routed around the first engaging member 44 and through the pair of openings 48 in the first sleeve member 32. The second loop 41 is routed around the second engaging member 46 and through the pair of openings 48 in the second sleeve member 34.

The connection between the sleeve 28 and slats 14 can take other forms. For example, the loop 40,41 can be adhesively secured to the sleeve members 32,34. Also, the loop 40,41 can be formed by taking an individual strand of material from the sleeve 28. Plastic or metal washers attached to loops or directly on the tubular sleeve could also be used. In addition, the loops 40,41 can be eliminated by adhesively securing the sleeves directly to the longitudinal edges 36 of the slats 14. A clip, such as engaging members 44,46, could be passed directly through the sleeve 28 and onto the longitudinal edges 36 of the slat, also eliminating the loop 40,41.

This connection of the tilt/lift mechanism 16 allows the plurality of slats 14 to be tilted to open and close the blind 10. As shown in FIG. 1, the end of the sleeve 28 that is located in the headrail 12 is connected to the tilt assembly 18 supported by the headrail 12. Specifically, the sleeve 28 is connected to the roller 22 supported on the shaft 20. By turning an actuating rod 25 of the gear mechanism 24, the sleeve 28 is taken up on the roller 22. Because the sleeve 28 is connected to each slat 14, the slats 14 are tilted to close the blind 10 (not shown). By turning the rod 25 in the opposite direction, the sleeve 28 is taken off of the roller 22 thus leveling the slats 14 and opening the blind 10.

Lift cords 30 are also used in the tilt/lift mechanism 16 to adjust the height of the blind 10. A lift cord 30 is utilized on each end of the blind 10. Conventionally, the lift cords 30 are connected to the bottom rail, extend upwards into the headrail 12, through the lift cord clutch 26, and then hang down from the headrail 12. As shown in FIG. 1, similar to the sleeves 28, the lift cords 30 are also positioned along the longitudinal edges 36 of the slats 14. Preferably, a lift cord 30 is used along opposing longitudinal edges 36 of the slats 14, on each side of the blind 10, making a total of four lift cords 30. In addition, as further shown in FIGS. 1 and 3, the lift cords 30 are positioned within the sleeves 28. Thus, a first lift cord 30 is positioned within the first sleeve member 32 and a second lift cord 30 is positioned within the second sleeve member 34. The lift cords 30 extend from the bottom rail and through openings 50 (FIGS. 1 and 2) in the headrail.

FIG. 2 shows the path of the lift cords 30 within the headrail 12. After passing through the openings 50 in the headrail 12, the lift cords 30 extend to the clutch 26 positioned proximate a front end portion of the headrail 12. The two lift cords 30*a*, 30*b* (FIG. 2) positioned at the front of the blind 10 extend directly across to the clutch 26, along an axis substantially parallel to the a longitudinal axis L of the headrail 12. The lift cords 30 pass through the clutch 26 and then hang down along the blind 10 as shown in FIG. 1. By pulling on the hanging portions of the lift cords 30, the bottom rail is evenly raised thus stacking the plurality of slats 14 on one another from the bottom towards the headrail 12. As the blind 10 is raised, the flexible sleeves 28 fold up. If desired, the hanging portions of the lift cords 30 can be connected to a fastener (not shown) connected to a single cord so that the single cord can be pulled to raise the blind 10 rather than having to pull evenly on the four separate lift cords 30.

A number of advantages are realized with the blind 10 having the tilt/lift mechanism 16 of the present invention. First, the connection between the sleeves 28 and slats 14 eliminates the need for ladder cords, thus allowing the slats to be more fully closed. In addition, the stack height of the blind when raised to an uppermost position is minimized since there is less structure, such as ladder cords and lift cords positioned between the slats. Likewise, the clip/loop connections also minimizes the stack height of the blind 10. Also, the slats 14 can be completely closed because the lift cords 30 do not pass through the slats 14, thus maximizing privacy. In addition, light cannot pass through the slats 14 because there are no holes or other perforations in the slats 14. Because the lift cords 30 do not pass through the slats 14, the slats 14 can be easily removed for cleaning, repair or replacement by removing the slats 14 from the clips 38.

The tilt/lift mechanism 16 of the present invention also reduces the friction present in the lift cords 30 when pulling on the lift cords 30 to raise the blind 10. First, a portion of the weight of the slats 14 is held by the sleeves 28 thus reducing tension on the lift cords 30. Also, the number of lift cords 30 utilized is doubled from conventional blinds. Normally, a pair of lift cords is used that pass through the center of each slat. In the present invention, four lift cords 30 are used thus reducing tension on each cord. Finally, in conventional blinds, the lift cords extend through holes in the slats and then into the center of the headrail. The lift cords then extend at an angle to the clutch, which increases the tension present in the lift cords and increases the friction when pulling the cords through the clutch. In the present invention, the lift cords 30 enter at the front of the headrail and extend directly across to the clutch rather than at an angle. This configuration reduces the amount of friction developed when pulling the cords through the clutch. Consequently, the lift cords are easier to pull to raise the blind 10.

While the specific embodiments have been illustrated and described, numerous modifications come to mind without significantly departing from the spirit of the invention and the scope of protection is only limited by the scope of the accompanying Claims.

I claim:

1. A window blind having a headrail housing a tilt assembly and a plurality of slats, the slats further having opposed external longitudinal edges, the blind comprising:

a sleeve extending from the tilt assembly to a bottommost slat along at least one external longitudinal edge of each slat, wherein the external longitudinal edge extends substantially the entire length of each slat;

a means for connecting the sleeve to each slat; and, a lift cord within the sleeve, and extending from the headrail to the bottommost slat wherein the cord is attached thereto.

2. The blind of claim 1 wherein the means for connecting the sleeve to each slat includes a clip and a loop for each slat, the clip engaging the slat and the loop cooperating with the clip and the sleeve.

3. The blind of claim 1 wherein the sleeve includes a first sleeve member and a second sleeve member, both sleeve members extending from the tilt assembly to the bottommost slat along the opposed external longitudinal edges of each slat.

4. The blind of claim 3 wherein the means for connecting the sleeve to each slat includes a clip and first and second loops, the clip having first and second engaging members engaging the opposed longitudinal edges of each slat, the first loop positioned around the first engaging member and through a pair of openings in the first sleeve member and the second loop positioned around the second engaging member and through a pair of openings in the second sleeve member.

5. The blind of claim 3 wherein the lift cord includes a lift cord within the first sleeve member and another lift cord within the second sleeve member.

6. The blind of claim 1 wherein each slat is a solid member having no holes.

7. The blind of claim 1 wherein the bottommost slat is a bottom rail.

8. The blind of claim 1 wherein the slats are individually removable from the blind.

9. The blind of claim 1 wherein the headrail houses a clutch positioned proximate a front of the headrail, the lift cord entering a front portion of the headrail wherein the lift cord extends to the clutch along an axis substantially parallel to a longitudinal axis of the headrail.

10. A window blind having a headrail housing a tilt assembly and a plurality of slats, the slats further having opposed external longitudinal edges, the blind comprising:

a sleeve extending from the tilt assembly to a bottommost slat along at least one external longitudinal edge of each slat, wherein the external longitudinal edge extends substantially the entire length of each slat;

a clip for each slat, each clip engaging the slat;

a loop cooperating with the clip and the sleeve; and, a lift cord extending from the headrail to the bottommost slat along an external longitudinal edge of each slat, wherein the external longitudinal edge extends substantially the entire length of each slat, the lift cord being connected to the bottommost slat.

11. The blind of claim 10 wherein the loop extends through a pair of openings in the sleeve and is positioned around the clip.

12. The blind of claim 10 wherein the lift cord is positioned within the sleeve.

13. The blind of claim 10 wherein each slat is a solid member having no holes.

14. The blind assembly of claim 10 wherein the slats are individually removable from the blind.

15. A window blind including a headrail housing a tilt assembly and a plurality of slats, the slats further having opposed external longitudinal edges, the blind comprising:

a first sleeve member and a second sleeve member, both sleeve members extending from the tilt assembly to a bottommost slat along the opposed external longitudinal edges of each slat, wherein the external longitudinal edge extends substantially the entire length of each slat;

a clip and first and second loops for each slat, the clip having first and second engaging members, the members engaging opposing external longitudinal edges of each slat, wherein the external longitudinal edge extends substantially the entire length of each slat, the first loop positioned around the first engaging member and through a pair of openings in the first sleeve member and the second loop positioned around the second engaging member and through a pair of openings in the second sleeve member; and, a lift cord within each sleeve member, and extending from the headrail to the bottommost slat wherein the cord is attached thereto.

* * * * *